United States Patent [19]

Kurinsky et al.

[11] 4,375,862

[45] Mar. 8, 1983

[54] CONTAINER WITH DOME COVER

[75] Inventors: Roger A. Kurinsky, Palatine; Fred D. Alexander, Arlington Heights; Michael E. Holzkopf, Libertyville, all of Ill.

[73] Assignee: Ekco Products, Inc., Wheeling, Ill.

[21] Appl. No.: 330,142

[22] Filed: Dec. 14, 1981

[51] Int. Cl.[3] ..... B65D 41/06; B65D 41/36

[52] U.S. Cl. ..... 220/293; 220/94 A; 220/306; 150/0.5; 206/45.32; 312/284

[58] Field of Search ..... 220/293, 288, 298, 306, 220/94 A; 150/0.5; 206/45.32; 312/284

[56] References Cited

U.S. PATENT DOCUMENTS

| | | | |
|---|---|---|---|
| 2,637,617 | 5/1953 | Stotter | 312/284 |
| 4,197,940 | 4/1980 | De Rossett | 150/0.5 X |

*Primary Examiner*—George T. Hall

*Attorney, Agent, or Firm*—Robert D. Teichert

[57] ABSTRACT

The combination of a circular container and cover having their rim and flange, respectively, formed to provide multiple, equally spaced locking means. The container and cover have a plurality of spaced notches and handles, respectively, formed on their outer side walls, said notches and handles providing means for handling and manipulating the container and cover for relative rotational movement therebetween to effectuate said locking means.

4 Claims, 7 Drawing Figures

FIG. 4
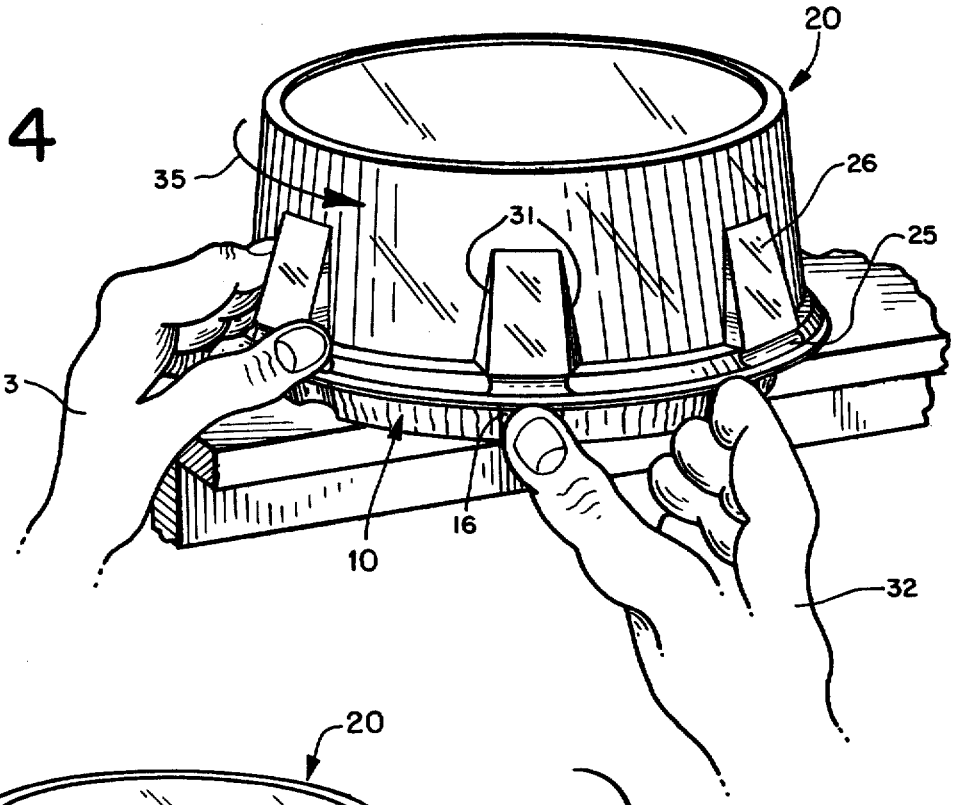
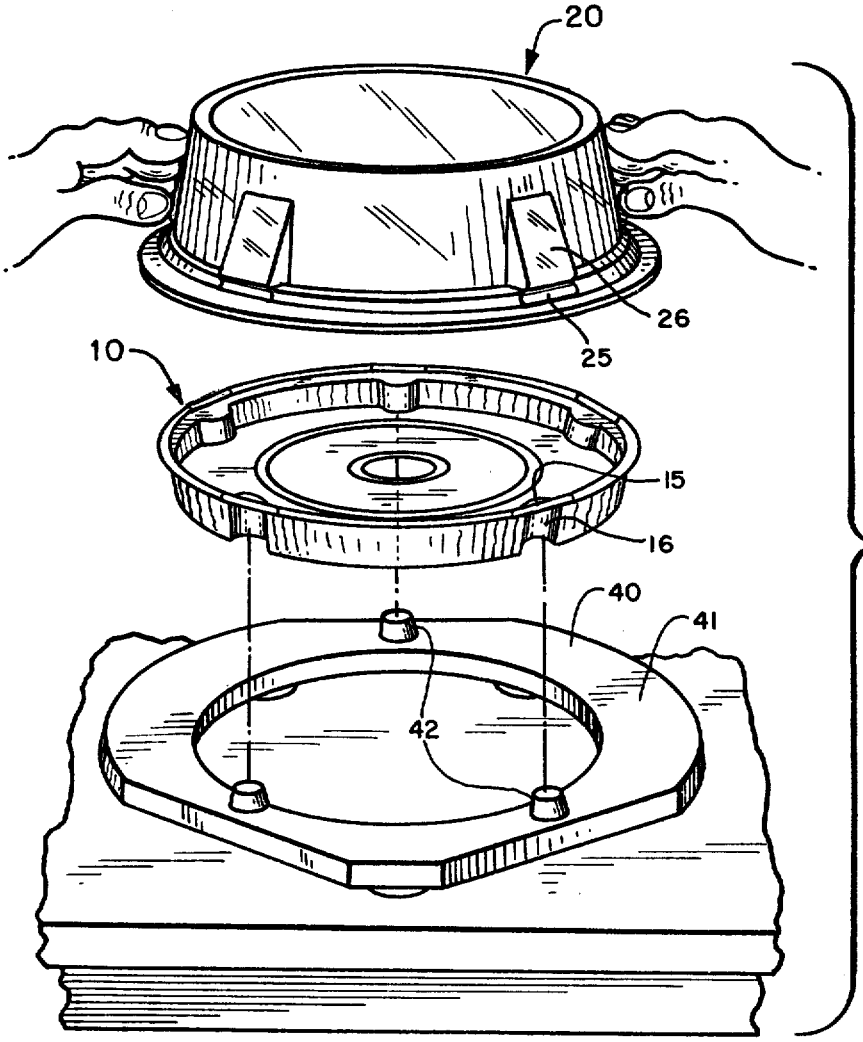
FIG. 5

CONTAINER WITH DOME COVER

BACKGROUND OF THE INVENTION

This invention relates to disposable containers having covers and particularly to such a container wherein the cover is releasably interlocked with the container by a bayonet closure, or similar closure means requiring rotational movement of the cover relative to the container.

In the use of covered containers to package, distribute and display food items it is desirable that the cover be of a transparent material to permit visual inspection of the packaged food. Therefore, and since the economies of disposable or non-reusable packaging demands a lightweight material for the cover, the cover normally is a see-through plastic of delicate and fragile construction. Such lightweight material does not offer the rigidity necessary for the use of standard closure means, such as crimping, and accordingly, securement of the cover to the container has been by heat sealing, sealing tape or stapling, depending on the composition of the container, or by forming the cover to provide a depending flange or portions of a flange to "snap-over" the rim of the underlying container. The sealing type closures are relatively expensive and the "snap" type closures result in loose or otherwise ineffective closures.

An inexpensive, positive closure, such as the bayonet type, that can be effective by interlocking the cover and container through rotational movement of one relative to the other is highly desirable. However, such a closure is difficult to achieve since the fragile nature of the lightweight plastic cover does not lend itself to the physical handling and manipulation for the required rotational movement. Furthermore, the problem is compounded when the cover is formed as a deep dome, such as to accommodate a two or three layer cake, which provides an unwidely configuration.

Accordingly, it is the primary object of this invention to overcome these disadvantages and provide a bayonet closure for locking a cover on a container, wherein the cover is formed of a fragile material.

SUMMARY OF THE INVENTION

The container, positioned upon upwardly, is circular having an outwardly extending rim with multiple, equally spaced flattened portions formed on the periphery of the rim. A domed cover, positioned open downwardly, is also circular having an outwardly and downwardly extending flange portion designed to overlie the container rim when the cover is placed on the container. The cover flange has multiple, equally spaced, inwardly extending lugs corresponding in number and shape with the container rim flattened portions, and which when aligned therewith permit axial movement of the cover onto the container whereby said lugs are disposed slightly below the container rim, whereupon rotational movement of the cover relative to the container will move the cover lugs under the container rim, to frictional engagement therewith. When the cover lugs are disposed under the container rim the cover cannot be moved axially away from the container.

To permit the holding of, and manipulation of, the container, the outer surface thereof is formed with a plurality of spaced indentations; and, to permit the holding of, and manipulation of, the cover, the outer surface thereof is formed with a plurality of spaced protuberances. The container indentations and the cover protuberances offer means whereby the container and cover can each by grasped by an individual's fingers and thumbs or by mechanical devices.

DESCRIPTION OF THE DRAWINGS

FIG. 4 is a perspective view of a container and cover in position for relative rotational movement one to the other for locking the cover to the container, and illustrating the positionment of an individual's thumbs and fingers to effect such relative rotational movement.

FIG. 5 is a perspective view of a container and cover of my invention shown in association with a support device for the container.

DESCRIPTION OF A PREFERRED EMBODIMENT

Figure 1:
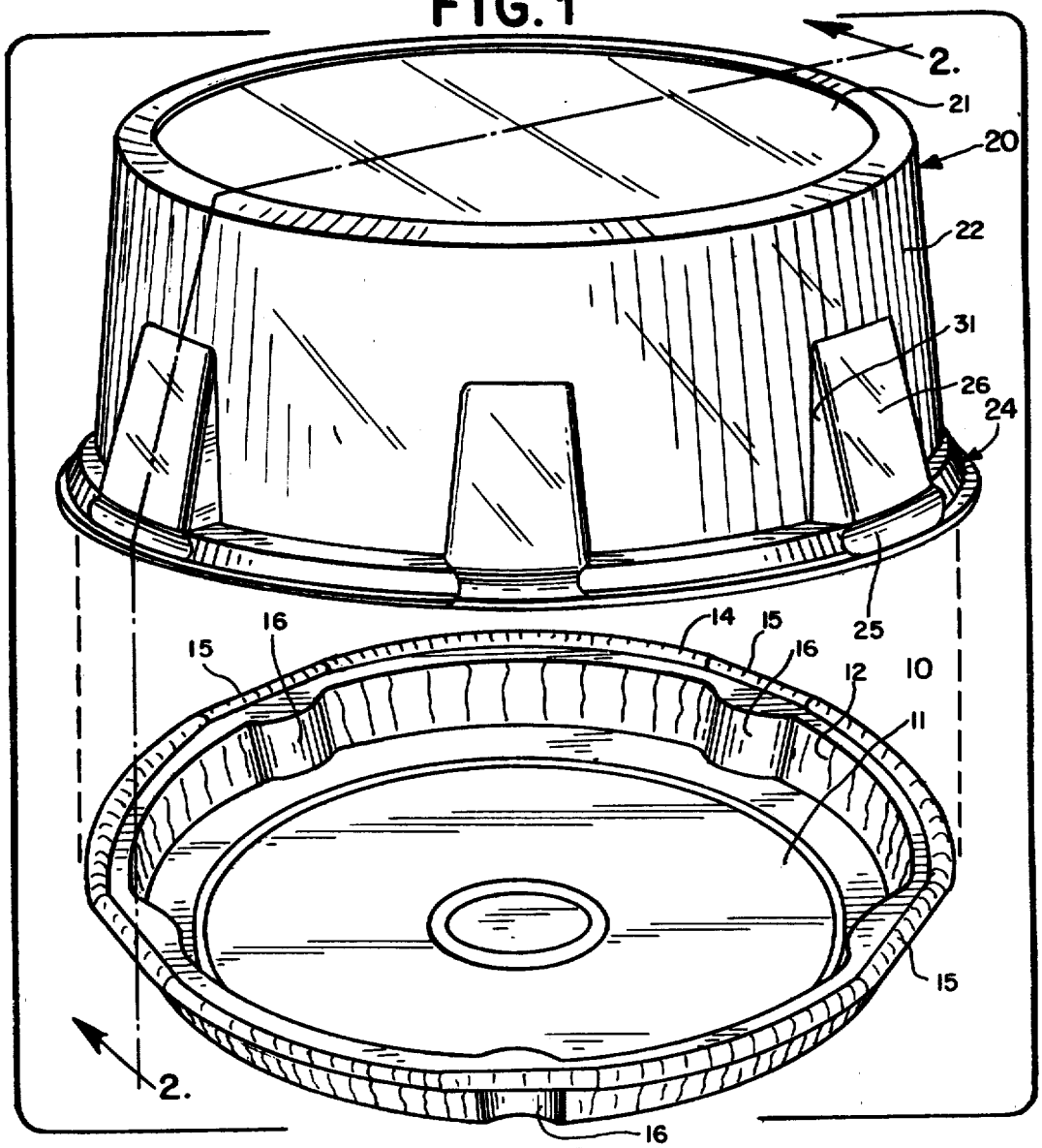
FIG. 1 is a perspective view of a container and cover embodying the features of the invention set forth herein.

Referring now to the drawings and specifically FIG. 1, the reference numeral 10 indicates a circular-shaped container comprising a bottom wall 11 having a side wall 12 extending upwardly therefrom and terminating in an outwardly extending rim 14. The rim 14 has multiple, equally spaced flattened portions 15 formed on the periphery thereof. The side wall 12 is formed to provide multiple, equally spaced indentations or notches 16 located in radial alignment with the flattened portions 15 of rim 14.

The reference numeral 20 indicates a circular-shaped cover comprising a top wall 21 having a side wall 22 depending downwardly therefrom and terminating in an outwardly and downwardly extending flange member indicated generally by the reference numeral 24. The flange 24 is formed to provide multiple, equally spaced shoulder portions or lugs 25 extending inwardly therefrom. The side wall 22 is formed to provide multiple, equally spaced protuberances or handles 26 located in radial alignment with the lugs 25 of flange 24.

Figure 2:
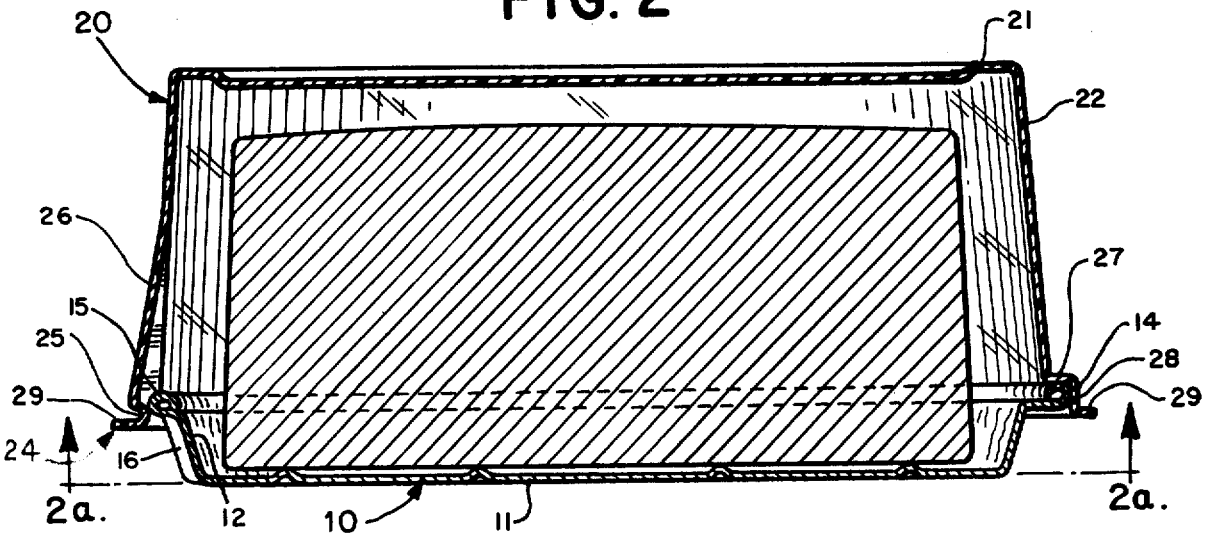
FIG. 2 is a sectional view taken along lines 2—2 of FIG. 1 but having the cover disposed on the container.

As shown in FIG. 2 the flange 24 comprises an outwardly extending ledge 27 and a downwardly extending leg 28 terminating in an outwardly extending lip 29. At selected positions on the flange 24 are the previously described lugs 25 formed at the lower part of leg 28 and aligned radially therewith are the associated handles 26, said handles being formed from the side wall material bulged outwardly in a manner to provide flattened spaced-apart portions 31.

Referring to FIG. 1 it can been seen that alignment of cover lugs 25 with container flattened portions or rim flats 15 permits the cover 20 to be placed on the container 10 whereby the cover flange 24 seats on container rim 14. The disposition of the cover lugs 25 relative to the rim flats 15 can best be seen in FIG. 2*a*.

Figure 3:
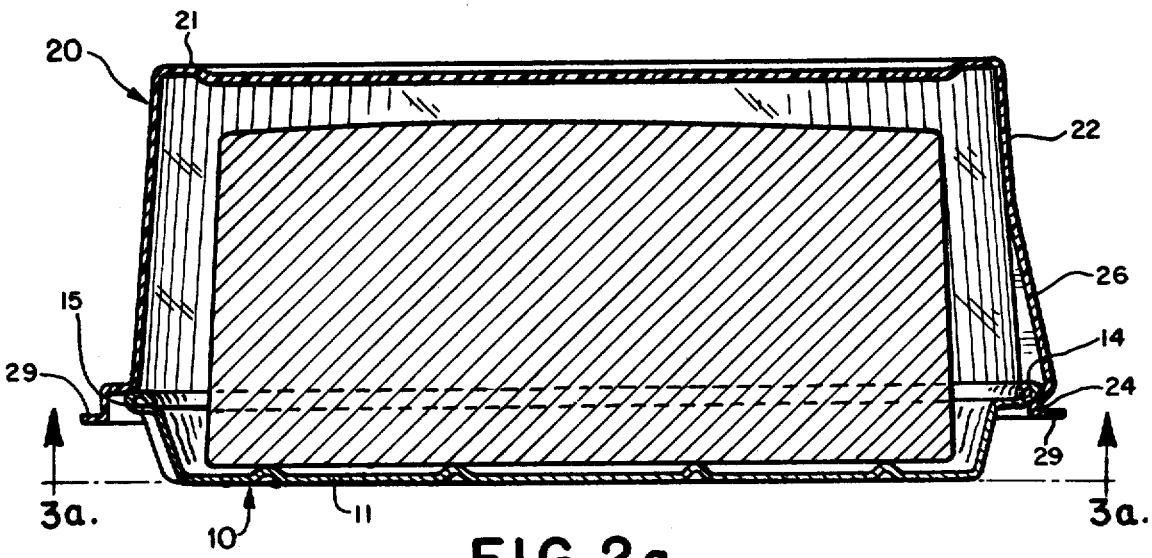
FIG. 3 is a view similar to FIG. 2 but showing the cover after rotation to dispose the cover lugs under the container rim.
Figure 2A:
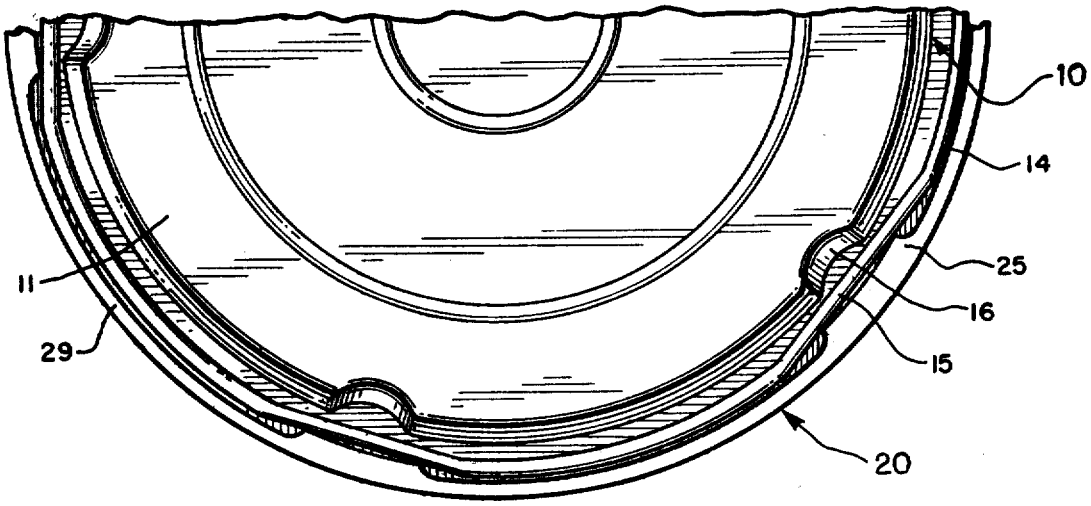
FIG. 2*a* is a bottom elevational view taken along lines 2*a*—2*a* of FIG. 2.
Figure 3A:
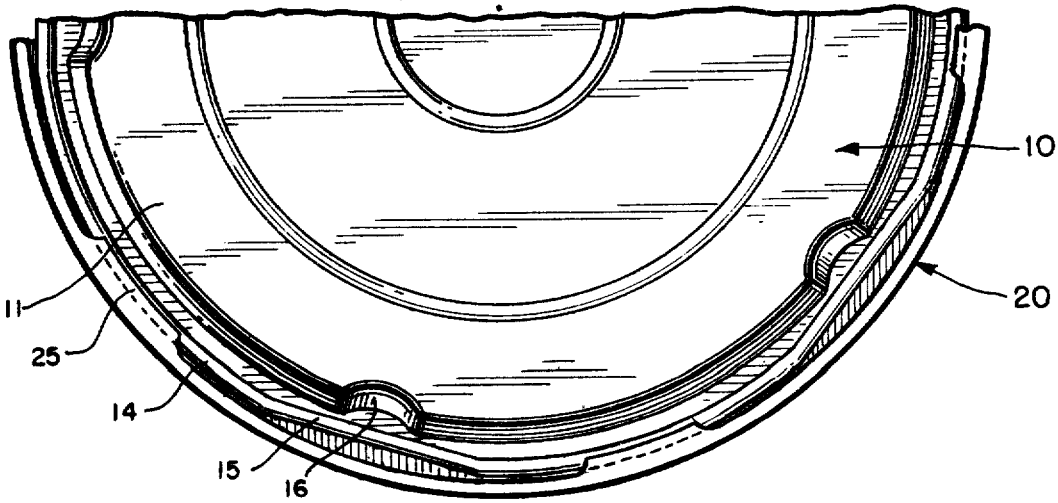
FIG. 3*a* is a bottom elevational view taken along lines 3*a*—3*a* of FIG. 3.

When the cover 20 has been disposed upon the container 10 as described in reference to FIGS. 1, 2 and 2*a* an interlocking closure of the cover and container can be achieved by rotational movement of the cover relative to the container. As shown in FIG. 4, the thumb and finger of an individual's one hand indicated by reference numeral 32 can be inserted in the notches 16 of the container 10, and the thumb and finger of an individual's other hand indicated by reference numeral 33 can grasp one of the handles 26 of the cover 20. Rotation of the cover as indicated by the directional arrow 35 will move the cover lugs 25 to disposition under the rim 14 thereby locking the cover 20 to the container 10. This interaction of elements can be seen by referring to FIGS. 3 and 3*a*. It is understood that the frictional engagement of cover lug 25 and container rim 14 is achieved at five spaced locations in the embodiment shown, but that the actual number of lugs may vary depending on such factors as the circumferential size of the cover 10 or the circumferential span of the lugs 25.

Referring now to FIG. 5 there is shown a support device 40 comprising a ring-like member 41 having multiple, equally spaced posts 42 extending upwardly therefrom. The posts 42 are of a shape and size to fit the notches 16 of container 10 thereby holding the container from rotational movement. Holding the container 10 stationary permits the use of both hands to handle and manipulate the cover 20. The size of some covers and their fragile nature makes such a holding device most helpful in achieving a quick as well as easy locking operation. It should be noted that while the directional arrow 35 of FIG. 4 indicates rotational movement of the cover 20 in a counter clockwise direction to achieve locking as described, that is merely the preferred rotational movement for the shown position of the hands 32 and 33. In fact, the cover 20 can be rotated either clockwise or counter clockwise to achieve locking by moving the cover lugs 25 from a position of alignment with the rim flats 15 to disposition under the adjacent portion of container rim 14. Such optional rotation is attainable when both hands are free to rotate the cover 20, as shown in FIG. 5. It should be clear that after a locked condition has been achieved, unlocking may be effectuated by rotational movement of the cover 20 relative to the container 10 to dispose the lugs 25 in alignment with the rim flats 15.

It is believed that the invention and many of its attendant advantages can be understood from the foregoing description and it will be apparent that various changes may be made in the form, construction and arrangement of parts without departing from the spirit and scope of the invention, the form hereinabove described being merely a preferred embodiment.

What is claimed is:

1. The combination of a circular container and a cover therefor having locking means for locking the cover to the container through rotational movement of the cover relative to the container, said container comprising a bottom wall having a side wall extending upwardly therefrom terminating in an outwardly extending rim, said cover comprising a top wall having a side wall depending therefrom terminating in an outwardly and downwardly extending flange adapted to seat on said container rim, holding means formed on the outer surface of the container side wall for gripping said container, and handle means formed on the outer surface of the cover side wall for grasping said cover.

2. A container and cover according to claim 1 wherein the locking means comprises multiple equally-spaced lugs formed on the cover flange extending inwardly therefrom, and the same number of multiple equally-spaced flats formed on the periphery of the container rim, whereby radial alignment of said lugs and flats permits axial movement of the cover relative to the container.

3. A container and cover according to claim 2 wherein the cover handle means comprises multiple equally-spaced protuberances radially aligned with the cover lugs, each lug constituting the lowermost terminus of the associated protuberance.

4. A container and cover according to claim 3 wherein the container holding means comprises multiple equally-spaced notches radially aligned with the container rim flats.

* * * * *